United States Patent [19]

Rabinow

[11] 4,111,019

[45] Sep. 5, 1978

[54] PICKPROOF LOCK

[75] Inventor: Jacob Rabinow, Bethesda, Md.

[73] Assignee: Hall & Myers, Washington, D.C.

[21] Appl. No.: 770,484

[22] Filed: Feb. 22, 1977

[51] Int. Cl.[2] ..... E05B 19/02; E05B 19/06; E05B 27/06

[52] U.S. Cl. ..... 70/358; 70/364 A; 70/407; 70/409; 70/419

[58] Field of Search ..... 70/358, 376, 378, 407, 70/364 A, 364 R, 409, 419

[56] References Cited

U.S. PATENT DOCUMENTS

| | | | |
|---|---|---|---|
| 64,975 | 5/1867 | Harris | 70/358 |
| 1,340,804 | 5/1920 | Thompson | 70/378 |
| 1,379,844 | 5/1921 | Andreani | 70/378 |
| 1,463,495 | 7/1923 | Borelli | 70/358 |
| 2,772,556 | 12/1956 | Nickel | 70/358 |
| 3,143,875 | 8/1964 | Wellekens | 70/382 |
| 3,194,034 | 7/1965 | Leiser | 70/358 |
| 3,303,677 | 2/1967 | Baver | 70/358 |

*Primary Examiner*—Robert L. Wolfe

*Attorney, Agent, or Firm*—William D. Hall; Geoffrey R. Myers

[57] ABSTRACT

This invention describes a pickproof lock consisting of a rotating cylinder provided with two sets of opposing tumblers. The tumblers permit a very thin key to be inserted between them. The key is made of a ribbon material of the order of one-hundredth of an inch thick and the tumblers are displaced in both directions from the center so that manipulation of a lockpicking tool becomes very difficult, since the tool must be as thin as the key and each set of tumblers must be in the correct position for the cylinder in turn.

22 Claims, 11 Drawing Figures

FIG. 1
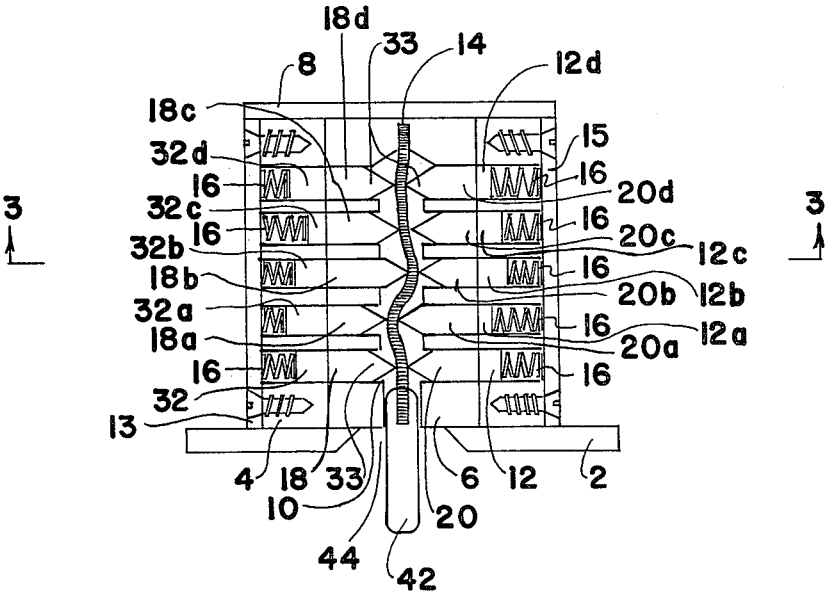
FIG. 2
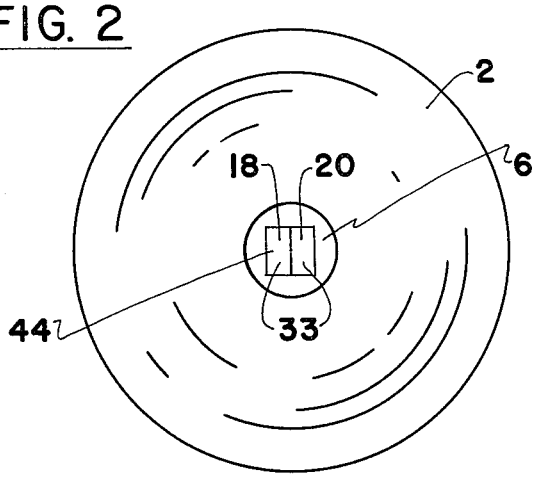
FIG. 3
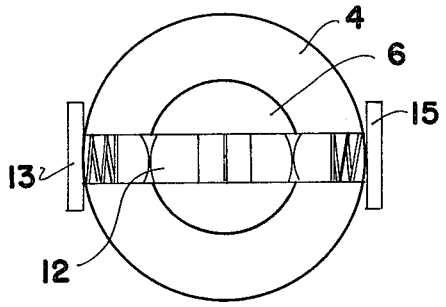
FIG. 4
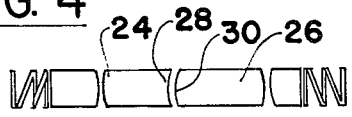
FIG. 5
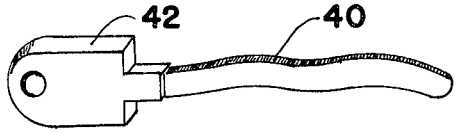
FIG. 7
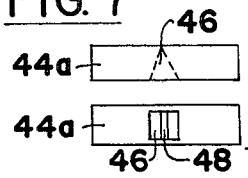
FIG. 8
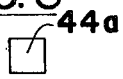
FIG. 9
FIG. 10
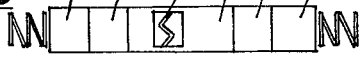
FIG. 11
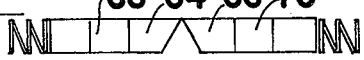
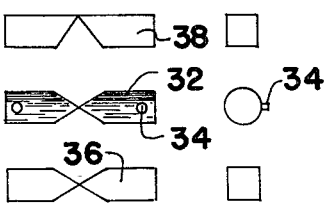
FIG. 6

PICKPROOF LOCK

BACKGROUND OF THE INVENTION

The usual cylinder lock using transverse tumblers can be picked by inserting the appropriate tool into the key slot and manipulating the tumblers. My invention makes such lock-picking difficult or impossible by making the key very thin and using two opposing sets of tumblers so that the space between the mating pairs of tumblers when the lock is ready to open is very small. This space is also very tortuous so that ordinary picking tools cannot be used.

The prior art shows a key having a zig-zag portion that is only a part of a more complicated key and operated on only one set of tumblers located on one side of the key. If there is only one set of tumblers to one side of the key, the lock can be picked in the conventional way, since the tool that is used for picking such a lock can be inserted on one side of the tumblers and push them over, to thus position the tumblers to open the lock.

It is an object of this invention to provide a lock that is more difficult to pick than prior art locks.

Another object of the invention is to provide a pickproof lock that is low in cost, yet is satisfactory in use.

SUMMARY OF THE INVENTION

The lock of the present invention is rendered substantially pickproof by having a multiplicity of opposing sets of tumblers positioned along the length of the key, with two tumblers of each of the opposing sets engaging opposite sides of the key respectively. In absence of the key, the opposing sets of tumblers meet, or substantially meet, each other, to thus interfere with any lock-picking attempt.

The advantage of the present invention is that a lock-picking tool cannot be easily manipulated since, if the tool pushes one of a tumbler pair to one side, the other side moves behind it and prevents the lock from opening. If the tumblers are separated by a thick tool, then, of course, the lock will not open. If one imagines that the correct key has an infinitely thin cross section, it is obvious that no lock-picking tool could be inserted into this lock. In practice, this is approached by having a key of the thickness of the order of 5 to 20 mils.

BRIEF DESCRIPTION OF THE DRAWINGS

FIG. 1 shows a cross section of my lock.

FIG. 2 shows the front view of my lock.

FIG. 3 shows the cross section of the lock taken along line 3—3 of FIG. 1.

FIG. 4 shows a set of tumblers and their springs.

FIG. 5 shows a key for my lock.

FIG. 6 shows alternate shapes of tumblers for my lock.

FIG. 7 shows another form of tumbler for my lock.

FIG. 8 is an end view of the tumbler of FIG. 7.

FIG. 9 is a top view of the tumbler of FIG. 7.

FIG. 10 is a front view of a modified tumbler together with additional tumblers to permit the use of a master key.

FIG. 11 is a front view of a set of tumblers such as shown in FIG. 6 but modified to permit the use of a master key.

DETAILED DESCRIPTION OF THE DRAWINGS

FIG. 1 shows a cross section of my lock. The lock comprises a front plate 2 fastened to the outside cylinder 4. Through the center bore of this cylinder 4 rotates an inner cylinder 6. Corresponding numbers are used in FIGS. 2 and 3. The back end of the lock is covered by a plate 8 fastened to the outside cylinder 4 by means such as screws or rivets. Crosswise through both the inner and outer cylinders are formed square holes 10 (these could also be rectangular), in which fit square (or rectangular) tumblers 12, 12*a* to 12*d*, 18, 18*a* to 18*d*, 20 20*a* to 20*d*, 32, 32*a* to 32*d*. The tumblers are wedge-shaped at their inner, opposing, faces 33 so as to permit a key 14 to enter between them. Conventional springs 16 are used behind the tumbler sets so as to urge them toward the center of the lock. The springs are held in place by cover plates 13 and 15 attached to the cylinder 4 by any suitable means. A key 14 is shown inserted between the tumblers 12 and the tumblers are shown in the position at which the lock can be turned.

Since the key is very thin, the lock is difficult to pick because to set each set of tumblers a tool must be able to transverse the tortuous path which permits the key to open the tumblers. While it would be, perhaps, possible to experiment with the front two tumblers 18 and 20 by inserting a thin blade between them, but as soon as they were put into their correct positions they prevent the manipulation of the subsequent tumblers. In practice the number of sets of tumblers, of course, could be larger, such as six or seven or eight, depending on security desired.

The front view of the lock is shown in FIG. 2. Here I show a square opening 44 into the inner cylinder which permits the key 14 with its modulations to be inserted. All of the tumblers such as 12, 18, 20, have the same vertical width as does the key 14 (see FIG. 2). FIG. 3 shows a section of the lock taken along line 3–3 of FIG. 1.

Since the key 14 must have sufficient stiffness to overcome the pressures of the springs behind the tumblers, I can make the key thinner while maintaining its stiffness by curving it in a direction perpendicular to its major axis. As shown in FIG. 4, the tumblers 24 and 26 have curved mating edges at 28 and 30 to conform to the curvature of the key suggested above. The keys 14 and 40, of course, would be curved to fit between these tumblers.

The key 40 itself is shown in FIG. 5 with the thickness of the key somewhat exaggerated. The thickness of the key 40 depends on the type of metal used. Thus, when the key is made of spring steel, its thickness depends on the quality of steel. The method of making, and duplicating, the key 40 is not part of this invention but is described in my co-pending Application Ser. No. 770,485, filed on even date herewith and entitled "Method of Making a Sheet Metal Zig-Zag Key". The key 40 can be stamped while in a hot condition so as to take a permanent set, or it can be stamped cold and the tumblers made to match its final shape. While the working section of the key 40 is made of thin metal, the handle 42 of the key can be made of thicker material. The opening 44 of the lock of FIGS. 1 and 2 can be made to fit this thick section of the key so that the torque to turn the cylinder 6 is provided by the handle 42 of the key 40 and not by the thin blade.

While I show, in FIGS. 1 through 7, tumblers with square cross sections, it should be understood that my invention can operate with tumblers of other cross section, such as round as shown at 32 in FIG. 6. Such round tumblers must be keyed in the holes in the lock by key-pins such as shown at 34 in FIG. 6. The passages in the lock, of course, must have keyways to match these pins 34.

While the mating ends of the tumblers may be shaped as indicated by tumbler 36 in FIG. 6, it is preferable to shape them as shown at 38 in that FIG. 6. This shape would make the insertion of the key 40 into the lock somewhat easier than if the tumblers had shape 36 of FIG. 6.

The lock and key described above operates as follows. When key 14 is inserted between the front edges 33 of the front tumblers 18, 18*a*, 18*b*, 18*c*, 18*d*, 20, 20*a*, 20*b*, 20*c*, and 20*d*, all of these front tumblers have their front ends touching the key and their rear ends at the inside wall of the inner cylinder 6. This presses the rear tumblers 12 and 12*a* to 12*d* and 32 and 32*a* to 32*d*, against their respective springs 16, to positions outside the inner cylinder 6 so that those rear tumblers will not interfere with the rotation of inner cylinder 6 by key 14. If, however, an incorrect key is inserted into the lock at least one of the sets of four tumblers (such as 12, 20, 18 and 32) will provide at least two tumblers (one on each side of the key) bridging the boundary between the inner cylinder 6 and the outer cylinder 4 to thus prevent the key from rotating the inner cylinder 6.

It is noted that, for each set of four tumblers, such as 12, 20, 18 and 32, the total length of the two front tumblers (such as 18 and 20) added to the thickness of key 14 equals the inner diameter of inner cylinder 6.

The lock includes supporting portions surrounding the tumblers so that the only path available for a lock-picking tool is between the forward edges 33 of the front tumblers. This makes it very difficult, if not impossible, to pick the lock.

In FIGS. 7 amd 8, a single front tumbler 44a, having a length equal to the width of inner cylinder 6, may replace the two tumblers 18 and 20 of FIG. 1. The tumbler 44*a* has a slot 48 having proper thickness and shape to receive the key. With the shape of slot 48 shown in FIG. 9, the key would have a flat cross-section. In a manner similar to the substitution of a single tumbler 44*a* for the two tumblers 18 and 20, a single tumbler, such as 44*a* with the slot 48 at a different position along the length of the tumbler, may replace any pair of front tumblers such as for example 18*c* and 20*c*.

While I show a lock that cooperates with a single key, it should be understood that the tumblers may be composed of more than two sections so that a master key may be used to open a set of locks with different keys being able to open only one of the set. Such systems of master keying are well known in the art and are described below.

If it is desired to have a master key for the lock, and still have the single front tumbler 50 intead of two front tumblers 18 and 20, four additional tumblers 53, 54, 55 and 56 may be added as shown in FIG. 10. The tumblers 53 and 54 are each of the same length. The length of tumbler 50 plus the length of any one of tumblers 53 or 54 is equal to the inside diameter of the cylinder 6. In this Figure I show a zig-zag slot 51 instead of the straight slot 48 of FIG. 9. The key to fit this zig-zag slot would, of course, have a corresponding zig-zag shape.

Similarly, the lock of FIG. 1, may be adapted to receive a master key by the addition of two additional tumblers to each of the five opposing sets of tumblers. Such an arrangement is shown in FIG. 11. In this Figure the thickness of the key 14 plus the length of tumblers 64 and 66 plus the length of any one of tumblers 68 and 70 equals the inner diameter of cylinder 6. Tumblers 68 and 70 are of equal length.

I claim:

1. A lock, and a key for the lock, comprising:

a casing, a rotatable cylinder in said casing, said cylinder having an axis, said cylinder including means which is adapted to receive a complementary key and which will permit the complementary key to rotate said cylinder, and tumbler means for preventing rotation of said cylinder without a complementary key, a key for said lock, said tumber means including a plurality of sets of tumblers, each set of tumblers including two front tumblers at least partially located in said cylinder and at least two rear tumblers, said front tumblers each having a rear end engaging a rear tumbler, the front tumblers of each set approaching different sides of said key, characterized by:

said key being a strip having two faces, said strip having a thickness of much smaller dimension than its width, said strip having a curvature, in a plane perpendicular to the faces of the strip, that is characterized by a series of bends in opposite directions to displace different tumblers different distances away from the axis of said cylinder so that the rear ends of said front tumblers align with the inner wall of said cylinder to permit the lock to be opened, said key being so shaped that it contains no longitudinal portion that is a straight line for the entire length of the key.

2. A lock and key as defined in claim 1 in which at least two sets of tumblers are opposing sets, and said tumbler means includes means to bias said front tumblers into either a closely adjacent, or a contiguous, relationship when there is no key in the lock, to thus interfere with the use of any lock-picking tool that may be inserted into said cylinder.

3. A lock and key as defined in claim 1 in which there is a set of tumblers ahead of the others, the tumblers of said last-named set being on a common diameter of said cylinder, said tumblers have key-engaging forward edges, and means in said cylinder adjacent said tumblers for preventing a lock-picking tool from passing the said sets of tumblers except between the front tumblers.

4. A lock and key as defined in claim 2 in which said front tumblers have key-engaging forward edges which are at least as wide as said key, said sets of tumblers including opposing sets, and means in said cylinder adjacent said tumblers for preventing a lock-picking tool from passing the said opposing sets of tumblers except between the front tumblers.

5. A lock and key comprising:

a casing, a rotatable cylinder in said casing, said cylinder including a front end defining an opening for receiving a complementary key, said cylinder also including means which will permit a complementary key to rotate the cylinder, and tumbler means for preventing rotation of said cylinder in absence of a complementary key, characterized by:

said key being a strip having lateral deformations to provide surfaces to engage said tumbler means, at least some of said lateral deformations being greater than the thickness of the strip, said tumbler means including several pairs of tumblers in said rotatable cylinder, said tumblers of each pair having forward ends which must closely approach each other so that said forward ends must form a tortuous passage through the cylinder conforming to said key surfaces in order for the cylinder to be free to rotate, said tortuous passage impairing passage of a lock-picking tool between said tumblers.

6. A lock as defined in claim 5 in which said tumblers are at least as wide as said key, and means for preventing a lock-picking tool from passing above, below or around said tumblers.

7. A lock as defined in claim 5 in which the tumblers of at least one of said pairs of tumblers are along a single diameter of said cylinder.

8. a lock as defined in claim 1 with a plurality of said sets of tumblers being along a plurality of different diameters, respectively, of said cylinder, said strip engaging the front tumblers of said plurality of sets of tumblers.

9. A lock as defined in claim 1 in which at least the front tumblers of at least one set of tumblers are positioned along a diameter of said cylinder.

10. A lock as defined in claim 1 in which a plurality of said sets of tumblers are respectively along a plurality of different diameters of said cylinder.

11. A lock as defined in claim 10 in which the ends of said front tumblers, which engage the complementary key, are at least as wide as said key.

12. A lock as defined in claim 10 in which the front tumblers have a square cross-section except for a limited forward portion which narrows to a forward blade which is narrow compared to the thickness of the square portion of the tumbler, said forward blade being the portion of the tumbler that engages the key.

13. A lock as defined in claim 11 in which said front tumblers each have a limited forward portion in which the thickness of the tumbler narrows to a key-engaging blade shaped end.

14. A lock and key as defined in claim 11 in which the several front tumblers are of such length that when a complementary key is properly inserted in the lock, and turned, all of said front tumblers extend from the key to the inner wall of said cylinder and the rear tumblers have their front ends riding on the outer wall of said cylinder.

15. A lock as defined in claim 5 in which:

said tumbler means having a series of complementary pairs of tumblers, each having a forward section, each pair of forward sections of said tumblers having a combined length which when added to the thickness of the key, is substantially equal to the inside diameter of the cylinder, with individual forward sections of said tumblers of some of said pairs differing in length from the forward sections of tumblers of other pairs, said series of pairs of tumblers engaging said strip at different places, respectively, along its length, and said strip having curvature so that the strip departs from a plane at, at least some of, said different places, the departure of said strip from a plane at said places being related to the lengths of said forward sections of said tumblers so that when said complementary key is properly positioned in said cylinder all of said forward sections of the tumblers are within the cylinder thus permitting the key to open the lock.

16. A lock together with its complementary key comprising:

a casing, a rotatable cylinder in said casing.

means, covering the front open end of said cylinder and defining an opening into which said key may enter, for enabling the key to rotate the cylinder, tumbler means for preventing rotation of said cylinder except with said complementary key, said tumbler means including opposing sets of tumblers at each of a series of predetermined locations along the path of the key, said complementary key comprising a strip adapted to be inserted in said opening and pass between said opposing sets of tumblers, said strip having a curvature in a plane perpendicular to the sides of the strip resulting in deformations away from a flat plane at, at least a plurality of said predetermined locations along said path of said key, each set of opposing tumblers being positioned along a diameter of the cylinder and having a rear tumbler and a front tumbler on each side of the key with the two front tumblers having front ends engaging opposite sides of the key, said front tumblers also having rear ends, said rear tumblers having front ends pressing against the rear ends of the front tumblers, each of said front tumblers having a length extending from said complementary key to the inside wall of the cylinder so that when the key is turned the front tumblers will remain wholly inside said cylinder and the rear tumblers will be outside said cylinder, said tumbler means including means biasing said rear tumblers toward said complementary key.

17. A lock and key as defined in claim 16 in which the front ends of the front tumblers are at least as wide as the key to thus interfere with any attempt to pick the lock by passing a lock-picking tool between the front tumblers.

18. A lock and key comprising:

a casing, a rotatable cylinder in said casing, said cylinder including means which is adapted to receive a complementary thin key and which will permit the complementary thin key to rotate said cylinder, tumbler means for preventing rotation of said cylinder without a complementary key characterized by:

said key being a strip having a thickness much smaller than its width, and said tumbler means including (a) inner tumblers extending along diameters of said cylinder, said inner tumblers having two free forward ends engaging opposing side walls of said key, said inner tumblers also having free rear ends, and said key departing laterally from a flat strip by distances greater than the thickness of the key for at least some of the positions where said front tumblers engage the key when the key is in a position to open the lock.

19. A lock and key as defined in claim 18 in which said tumbler means include at least one tumbler having a narrow slot through which said complementary key may pass and which is positioned, when said complementary key is inserted in the lock, into a position where said free ends conform to the inner diameter of said cylinder.

20. A lock and key as defined in claim 18 in which said tumbler means comprise plural tumblers which when positioned by a complementary key extend from one end of a diameter of said cylinder to the other end of said diameter.

21. A lock and key as defined in claim 18 in which the thickness of the key is on the order of 5 to 20 mils.

22. A lock comprising:

a casing, a rotatable cylinder in said casing, said cylinder including a front end defining an opening for receiving a complementary key, said cylinder also including means which will permit a complementary key to rotate the cylinder, and tumbler means for preventing rotation of said cylinder in absence of a complementary key, characterized by:

said tumbler means including several pairs of opposing tumblers, each pair of tumblers having forward ends that always remain closely adjacent to each other and which when in a position permitting the lock to open includes at least one tumbler intercepting any straight path through the cylinder.

* * * * *

UNITED STATES PATENT OFFICE

CERTIFICATE OF CORRECTION

Patent No. 4,111,019 Dated Sept. 5, 1978

Inventor(s) Jacob Rabinow

It is certified that error appears in the above-identified patent and that said Letters Patent are hereby corrected as shown below:

After "Assignee: Hall & Myers, Washington, D. C.", insert -- a part interest --.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*